US005752572A

United States Patent [19]

Baiden et al.

[11] Patent Number: 5,752,572

[45] Date of Patent: May 19, 1998

[54] TRACTOR FOR REMOTE MOVEMENT AND PRESSURIZATION OF A ROCK DRILL

[75] Inventors: Gregory R. Baiden, Lively; Donald D. Young, Sudbury; Fredric C. Delabbio, Sudbury; Jean P. Pascoli, Sudbury; Paul de Vlugt, Val Caron, all of Canada

[73] Assignee: Inco Limited, Toronto, Canada

[21] Appl. No.: 711,512

[22] Filed: Sep. 10, 1996

[51] Int. Cl.[6] ..... E21B 44/00

[52] U.S. Cl. ..... 175/26; 175/51; 175/230

[58] Field of Search ..... 175/26, 45, 51, 175/76, 135, 230, 296

[56] References Cited

U.S. PATENT DOCUMENTS

| | | | |
|---|---|---|---|
| 3,088,532 | 5/1963 | Kellner | 175/230 |
| 3,371,729 | 3/1968 | Carr | 175/293 |
| 4,471,843 | 9/1984 | Jones, Jr. et al. | 175/73 |
| 4,572,305 | 2/1986 | Swietlik | 175/325 |
| 4,844,178 | 7/1989 | Cendre et al. | 175/73 |
| 5,168,941 | 12/1992 | Krueger et al. | 175/26 |
| 5,293,945 | 3/1994 | Rosenhauch et al. | 175/325.2 |
| 5,311,954 | 5/1994 | Quintana | 175/61 |
| 5,316,094 | 5/1994 | Pringle | 175/74 |
| 5,449,047 | 9/1995 | Schivley, Jr. | 175/51 X |

*Primary Examiner*—William P. Neuder

*Attorney, Agent, or Firm*—Blake T. Biederman; Edward A. Steen

[57] ABSTRACT

The invention provides a tractor for locomoting a drilling apparatus. The tractor includes a retractable body for transporting and pressurizing a drill attached to a front drilling end of the retractable body. The retractable body is longitudinally extended and contracted for length adjustment. A drill stabilizer is attached to a rear trailing end of the retractable body. The drill stabilizer is extended to secure said retractable body during drilling and retracted for allowing movement of the rear trailing end of the retractable body. A position stabilizer is attached to the front drilling end of the retractable body. The position stabilizer is transversely extendable against the sidewalls of the drill hole for periodically stabilizing the retractable body. The position stabilizer retracts for operation of the drill when the drill is stabilized with the drill stabilizer. The tractor travels by extending and retracting the drill stabilizer, extending and retracting the position stabilizer and adjusting length of the retractable body.

18 Claims, 3 Drawing Sheets

TRACTOR FOR REMOTE MOVEMENT AND PRESSURIZATION OF A ROCK DRILL

FIELD OF INVENTION

This invention relates to the field of the operation and guidance of rock drills. In particular, this invention relates to remote pressurization, operation and movement of an In-The-Hole type rock drill.

BACKGROUND OF THE INVENTION

In recent years, the underground mining industry has extensively used long-hole production methods to increase ore recovery rates and to reduce mining costs. Implementation of these methods has relied on the accurate drilling of blastholes over distances ranging from about 70 to 140 meters. Conventional hardrock drilling equipment however, has no effective means for controlling the path of drilling equipment. As a result of this lack of directional control, excessive deviation of blastholes from their intended trajectories is a frequent and costly occurrence. The resulting incorrect positioning of explosives often causes inefficient blasting. This inefficient blasting results in poorly fragmented rock that accelerates the wear rate of ore handling and crushing equipment. Furthermore, inaccurate drilling may account for unacceptable levels of waste rock in the recovered ore. In summary, the entire mining process is adversely affected by the dilution and poor fragmentation of the recovered ore that directly or indirectly result from inaccurate drilling.

Presently, In-The-Hole (ITH) drills represent the state of the art in commercially available long-hole drilling technology. Typically, heights of ITH drill rigs are restricted to a mine tunnel height of 14 feet (4.3 m). To operate an ITH drill, torque and axial thrust are transmitted to a hammer through a series of steel pipes or drill rods from an underground location within a mine. The drill rods form a continuous shaft from a rotary drive head at the collar of a hole through to a hammer that drives the bit. These drill rods have a threaded connection that allows them to be joined in a long "string" as the hole gets deeper. The interior of the drill string carries the compressed air or water used in the operation of the ITH hammer. The exterior diameter of the string determines the annular area of the hole and consequently the velocity of the exhaust air or water. The drill rod is sized to allow appropriate fluid flow through the string and to provide sufficient exhaust velocity to bail the cuttings from the bottom of the hole to the surface. A power unit consisting of a prime mover (diesel, electric or air) that drives one or more hydraulic pumps is used to turn the drill string from the surface. The oil flow generated by the pump(s) is directed through appropriate valving to the various hydraulic actuators that control the functions required in the operation of the drill from the surface. Typical deviations for ITH drills are in the range of 10% of hole length. Consequently, ITH drills are extremely inaccurate for modern mining practices.

Typically, the drilling rate of production for ITH drills is approximately 0.3 meters per minute, depending on the type of ore encountered and drill parameters. But the actual time required to drill a hole is much greater than this rate suggests. The drill string arrangement typically consists of 5 ft (1.64 m) long drill rods attached in series. After each 5 ft (1.64 m) increment of drilling, the drilling must be stopped to add another rod. To add a new drill rod, the drive head is decoupled from the previous rod and reset. A new rod is positioned and connected and the air in the string is brought back up to pressure before the drilling resumes. This procedure causes an interrupted drilling cycle and reduces the effective drilling rate considerably.

Recently, systems have been developed for improving the accuracy of rotary drills. The petroleum and gas industries widely use rotary drills to drill through relatively soft rock from unrestricted surface locations. The rotary drills typically contain tri-cone bits, but may simply contain churn drills for soft ground. In U.S. Pat. No. 4,471,843 ('843), Jones, Jr. et al. disclose a drill string that included a plurality of deflector pads for centralizing a drill bit within a drill hole. The deflector pads of the '843 patent are optionally adjusted to steer the drill string. Similarly, Cendre et al., in U.S. Pat. No. 4,844,178, disclose the use of three sets of stabilizers for guiding the path of a drill string. A downhole adjustable stabilizer for a drill string that may be steered by downhole "smart" guidance or surface generated communication was disclosed by Rosenhauch et al., in U.S. Pat. No. 5,293,945. Although the above systems claim to minimize the guidance problems associated with rotary drills, the above systems continue to possess the disadvantages associated with drill string operations. Furthermore, none of the above guidance devices is designed to survive the extreme vibrations and shock created by the hammer of an ITH drill.

It is an object of this invention to provide an an device for locomoting, pressurizing and steering a rock drill.

It is a further object of the invention to eliminate the requirement to periodically connect and disconnect drill strings while operating a long-hole drill.

It is a further object of the invention to provide an ITH device having increased drilling speed, range and accuracy.

It is a further object of the invention to provide an ITH device capable of sensing and locating cracks and voids in rock structures.

SUMMARY OF THE INVENTION

The invention provides a tractor for locomoting a drilling apparatus. The tractor includes a retractable body for transporting and pressurizing a drill attached to a front drilling end of the retractable body. The retractable body is longitudinally extended and contracted for length adjustment. A drill stabilizer is attached to a rear trailing end of the retractable body. The drill stabilizer is extended to secure said retractable body during drilling and retracted for allowing movement of the rear trailing end of the retractable body. A position stabilizer is attached to the front drilling end of the retractable body. The position stabilizer is transversely extendable against the sidewalls of the drill hole for periodically stabilizing the retractable body. The position stabilizer retracts for operation of the drill when the drill is stabilized with the drill stabilizer. The tractor travels by extending and retracting the drill stabilizer, extending and retracting the position stabilizer and adjusting length of the retractable body.

DESCRIPTION OF PREFERRED EMBODIMENT

Figure 1:
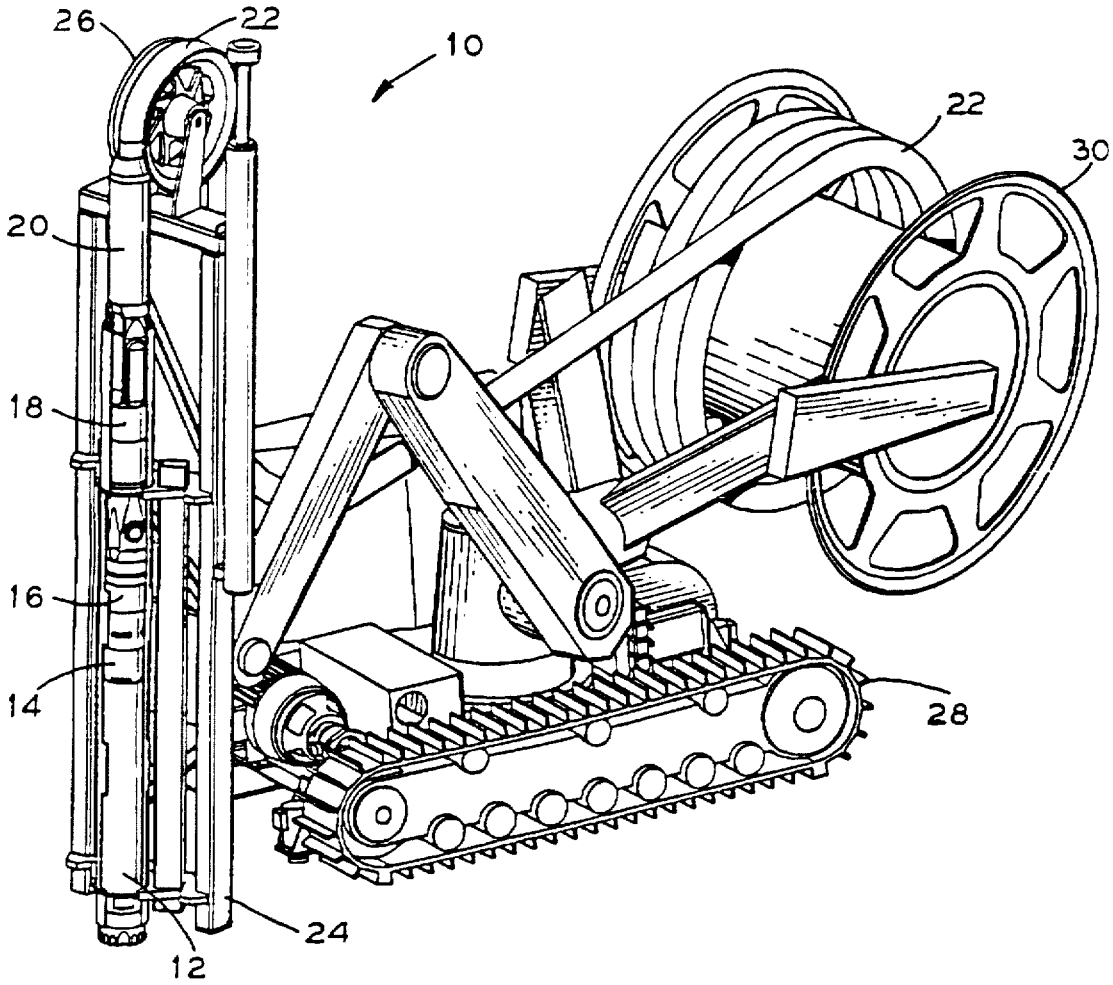
FIG. 1 is a perspective view of an embodiment of the invention.

The invention provides a tractor for remotely powering and operating drills used for long-hole drilling. Referring to FIG. 1, the tractor of the invention is most advantageously used as a component of guided drilling system 10. The guided drilling system 10 consists of percussive hammer 12, shock absorber 14, rotate drive 16 and tractor 18. Percussive hammer 12 is transported and pressurized with tractor 18. Rotate drive 16 is used to rotate the percussive hammer 12 at a relatively slow rate. Shock absorber 14 protects sensitive equipment from the severe vibrations originating from percussive hammer 12. In addition, shock absorber 14 stores and returns mechanical energy for use with each compression cycle of percussive hammer 12. The tractor 18 is controlled and steered with control section 20. The control section 20 provides for accurate drilling through a predetermined drill route.

A flexible umbilical conduit 22 provides power supply lines and control lines for the drill. The supply lines advantageously supply hydraulic power, pneumatic power or a combination thereof. Most advantageously, percussive hammer 12 is operated with pneumatic power. Rotate drive 16 and tractor 18 are most advantageously operated with hydraulic power. The initial trajectory of the unit is established with support frame 24 and feed pulley 26. Advantageously, the guided drilling system is provided with means for self-propelled motion such as engine powered tracks 28. The flexible umbilical conduit 22 is advantageously designed with sufficient flexibility to be repeatedly coiled around and uncoiled from feed reel 30.

Figure 2:
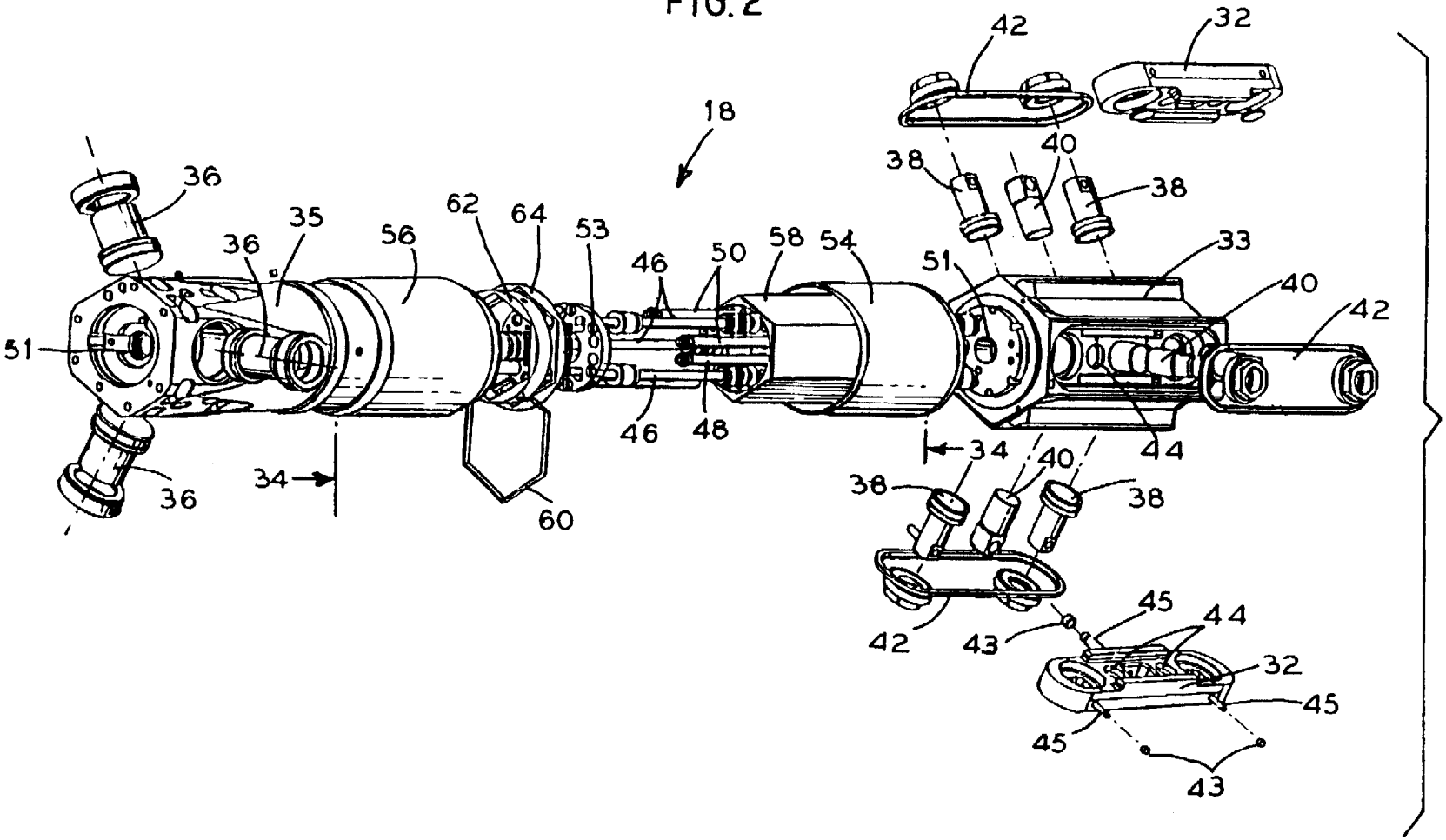
FIG. 2 is a partially exploded side view of an embodiment of the invention with a shoe removed and sections partially broken away.

Referring to FIG. 2, the tractor 18 advantageously consists of a rear section 33 containing a drill stabilizer that consists of three rear guide shoes 32. A retractable extension zone 34 connects rear section 33 to front section 35. Front section 35 contains a position stabilizer that consists of three front holding shoes 36 for periodically securing the tractor 18. It is possible, but not practical, to secure the tractor with a single rear guide shoe and a single front holding shoe. The primary functions of the tractor section include: maintaining a secure position of the drill inside the hole, providing the axial thrust required to advance the drill and adjusting the direction of drilling.

The rear guide shoes 32 contain a pair of hydraulic pistons 38 that are transversely extendable. Center guides 40 are most advantageously used to ensure linear movement of rear guide shoes 32. Rear shoe seals 42 are transversely projected with hydraulic pistons 38 to secure tractor 18 by pressing the guide shoes 32 against the sidewall of a drill hole. Rear shoe seals 42 serve to prevent cuttings dust and debris from entering the space below the rear guide shoes 32 as they extend and retract. In addition, the rear guide shoes 32 are periodically retracted to allow movement of tractor 18 within a drill hole. The rear guide shoes 32 are advantageously slideably attached with plugs 43 and pins 45 to loosely secure the rear guide shoe 32 to the rear section 33. This slideable attachment provides for sufficient retraction of rear guide shoes 32 for the periodic movement of tractor 18.

Advantageously, a linear variable differential transformer (LVDT) is mounted at positions 44 of each guide shoe. Most advantageously, the average reading arising from the pair of LVDTs measures the displacement and angularity of each shoe as it extends. This information is then sent to the guidance system (20 of FIG. 1) to control the mean displacement of each rear guide shoe 32. Most advantageously, the guidance system controls the drill with electro-hydraulic-servo valves that individually control at least three rear guide shoes 32. The displacement of each rear guide shoe 32 is then used to control the trajectory of the drill. The guidance system or device advantageously consists of a combination of gyroscopes and accelerometers that determine the orientation of the drill. Most advantageously, the guidance system provides mine coordinate location, dip angle, azimuth angle and drill hole length.

The retractable extension zone 34 provides axial thrust for the operation of a drill or hammer with three hydraulic thrust cylinders 46. Optionally, one or more hydraulic thrust cylinders 46 may be used. But it is preferred to use at least three hydraulic cylinders 46 to balance the axial thrust. The three thrust cylinders 46 operate in parallel through a 6 inch (15.25 cm) stroke to advance the front drilling end components of the tractor as the bit penetrates into the rock. For an 8.5 inch (21.6 cm) diameter drill, the three hydraulic cylinders 46 advantageously provide at least 5,280 lbf (23,500N) to the drill bit. Alternately, thrust of hydraulic cylinders 46 may be operated at only about 1,000 lbf (4,450N) to optimize the rate of drilling under certain conditions.

Advantageously, a sensor such as an LVDT measures the advance of the front section 35. Variable length hydraulic transfer tubes 48 and 50 transfer hydraulic power through extension zone 34. Hydraulic transfer tubes 48 and 50 extend and retract with the movement of extension zone 34. The extension zone 34 of FIG. 2 uses two hydraulic inlet transfer tubes 48 and two hydraulic outlet transfer tubes 50. (The second hydraulic inlet line is not illustrated in FIG. 2.) A centrally disposed pneumatic transfer tube supplies air through passages 51 to the drill for hammer operation and removal of rock chips. The removed rock chips are pneumatically transported between tractor 18 and the inside of the drill hole. Advantageously, the hydraulic and pneumatic transfer tubes contain ball joints at each end to permit a small amount of deflection through extension zone 34. Most advantageously, the hydraulic and pneumatic transfer tubes are connected between a pair of connector plates 53. (The second connector plate is partially illustrated in FIG. 2.)

The tractor includes rear cover 54 and front cover 56 for protecting extension zone 34 from debris. An interlocking steel hexagonal shaft 58 is contained within rear cover 54 and front cover 56. The hexagonal shaft 58 slides with respect to front section 35 and front cover 56 to provide for longitudinal extension and contraction of the extension zone. Two hexagonal bearings 62 (one not illustrated) transfer torque to the rear shoes 32. Optionally, wiper 60 secured to wiper cap 64 protects hexagonal shaft 58 from debris. But when covers (54, 56) are present, wiper 60 and wiper cap 64 become unnecessary. The bearings are fixed within front section 35 to prevent twisting about the moment arm of hexagonal shaft 58. The hexagonal shaft slides inside the bearings to provide for extension and retraction of the extension zone 34 without axial twisting. In addition, alternate slidable means for transmitting torque through the extension zone may be used. Splined, keyed or other geometrical shapes such as interlocking pentagon-shaped shafts may be used to control twisting of extension zone 34. Furthermore, the hexagonal bearings 62 serve to reduce friction as shaft 58 extends and retracts. The bearings 62 are advantageously constructed out of a durable, low friction material. Most advantageously, the bearings 62 are constructed of Duralon™ fiberglass wound bearings Duralon is a trademark of Rexnord Corporation.) to provide axial movement and torque transmission with a low sliding friction and without binding, galling or scoring. In addition, the Duralon bearings are advantageous since they effectively reduce friction without any requirement for lubrication.

The front holding shoes 36 extend against the sidewalls of a drill hole to support the drill while the rear portion of the tractor is moving. The front shoes 36 are capable of holding the drill under the same loading conditions as the rear shoes 32. Since the front shoes 36 provide no steering function, they do not require individual control. Advantageously, one hydraulic supply line controls all front shoes 36. Most advantageously, software measures the rate of pressure increase as the shoes make contact with the inside of a drill hole or reach full extension. The indication of a full extension determines the presence of a crack or void. If a void is located, the void may be avoided by retracting the front shoes 36 and retracting extension zone 34 to a position wherein the front shoes 36 can be pressed against a solid sidewall of the drill hole. Optionally, the rate of pressure-increase determines rock conditions adjacent front shoes 36.

Figure 3D:
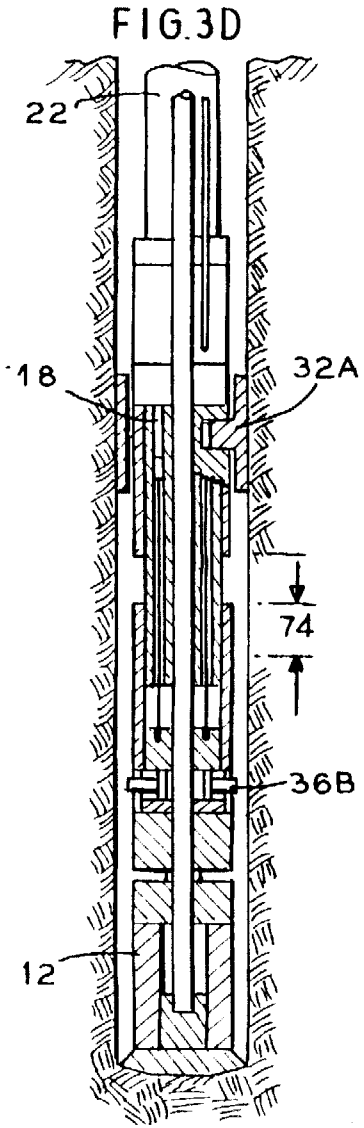
FIG. 3 is a schematic view of the tractor of the invention that illustrates operation of the tractor in a drill hole.
Figure 3C:
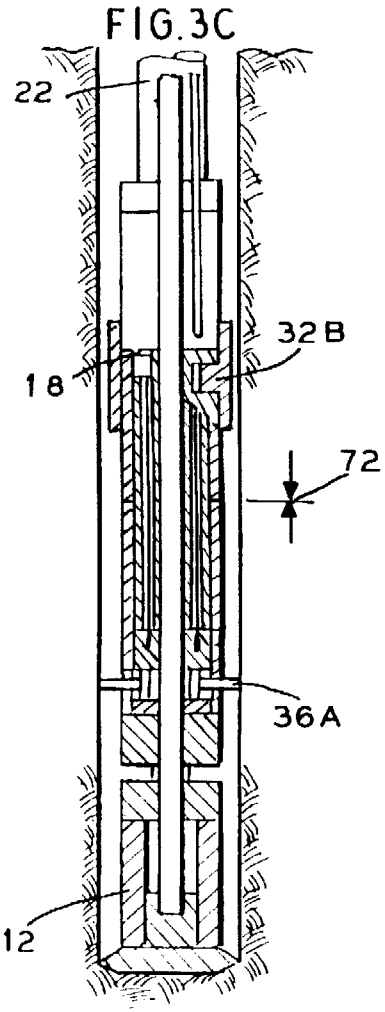
Figure 3B:
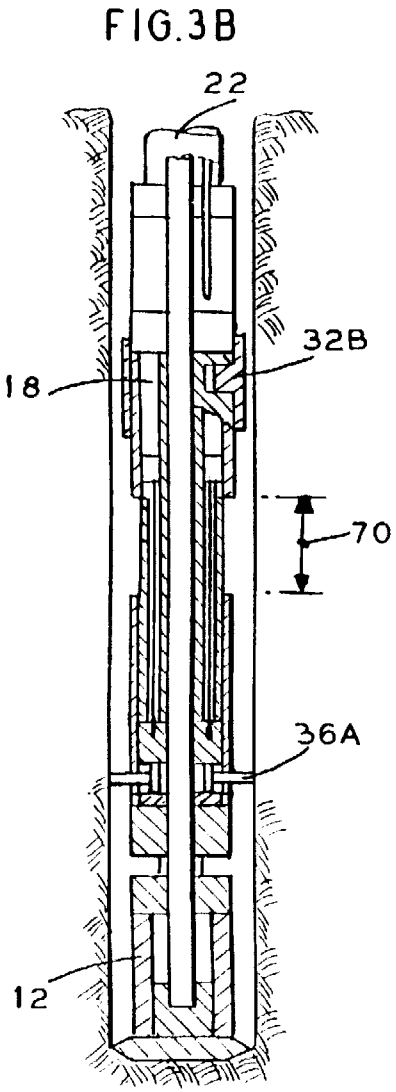
Figure 3A:
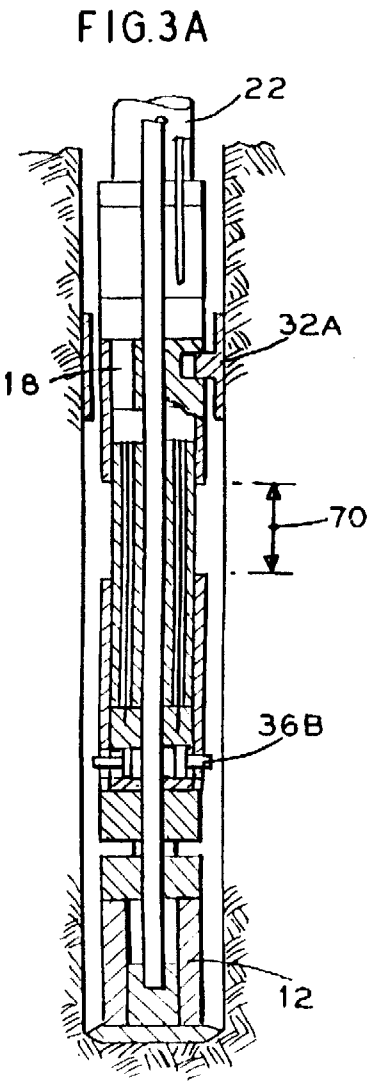

Referring to FIGS. 3A to 3D, the drilling sequence essentially consists of a four step operation. FIG. 3A illustrates the initiation of a drilling cycle. At initiation: rear guide shoes 32A are laterally extended in the "A" or gripping position; retractable extension zone is fully extended longitudinally to position 70; and front holding shoes 36B are in the "B" or inward position.

Referring to FIG. 3B, the front holding shoes 36 are then laterally extended to secure the drilling section. After the front shoes have secured the drill, the rear guide shoes 32B are retracted. The secured front shoes 36A prevent the entire drilling lines from vibrating with the pneumatic hammer. Furthermore, while the drill secures the front shoes 36A, the compression arising from a spring-loaded shock absorber advantageously provides forward thrust for temporary operation of the drill. This stabilization of the pneumatic hammer most advantageously provides for continuous operation of a drill while the remainder of the tractor is locomoting.

In FIG. 3C, the drilling section contracts to position 72 by retracting the hydraulic thrust cylinders to downwardly pull the released rear shoes 32B and the flexible umbilical conduit 22. During this step, percussive hammer 12 most advantageously continues to drill under the support of gripping front shoes 36A.

After the rear guide shoes 32A of FIG. 3D return to the gripping position, the front holding shoes 36B are released. (The rear guide shoes 32 may be variably extended to steer the drilling unit.) The hydraulic thrust cylinders are then activated to axially thrust the pneumatic hammer into compression against rock at the forward end of a drill hole. The thrust cylinders then drive the pneumatic hammer through power stroke 74 until it reaches the fully extended position 70 (FIG. 3A). After the piston is fully extended, the drilling cycle is repeated. Most advantageously, drilling cycles are repeated in a manner that provides for continuous drilling. A control means such as an electronic control circuit or computer controls the movement of the tractor. Most advantageously, the tractor is connected to the initial drilling surface with a "hard" wire connection for improved control.

The upward movement of the drill system may be accomplished by reversing the tractor sequence. Alternately, the rear and front shoes may be retracted and the entire drill rig may be retrieved simply by reeling up a retrieval wire connected to the tractor.

The tractor-based drill system of the invention is capable of forming holes that have an accuracy of greater than about ±0.3 m at a depth of 200 meters. The radius of curvature for the present design of the invention is between about 1,000 m and 1,200 m. The radius of curvature may be further reduced to 300 m by increasing the diameter of the drill bit from 8½ in (21.6 cm) to 8¹³⁄₁₆ in (22.4 cm).

The invention provides an ITH tractor that is capable of remotely locomoting, pressurizing and steering a drill string in any direction. The invention may use a flexible umbilical conduit to eliminate the delay associated with connecting drill rods. In addition, since drill rods may be eliminated, one operator may effectively operate multiple drilling systems. Furthermore, the tractor of the invention has steering ability for improved accuracy. The improved accuracy eliminates re-drilling and reduces processing of waste rock. Furthermore, the improved accuracy provides for the drilling of ideal patterns that improve fragmentation and deliver consistently sized muck. This improved fragmentation results in better handling and processing of ore with reduced wear on equipment. Furthermore, the improved fragmentation minimizes the need for secondary blasting. Finally, the unique tractor device may be equipped to sense and avoid cracks and voids that occur in rock structures.

In accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A tractor device for locomoting a drilling apparatus comprising:

a retractable body, said retractable body having a drill attached to a front drilling end of said retractable body and said retractable body having means for longitudinally extending and retracting for adjusting length of said retractable body and pressurizing said drill against the forward end of a drill hole during drilling.

a drill stabilizer attached to a rear trailing end of said retractable body for stabilizing said drill during drilling, said drill stabilizer being transversely extendable against sidewalls of the drill hole for securing said retractable body during drilling and transversely retractable for allowing movement of said retractable body, a position stabilizer attached to said front drilling end of said retractable body, said position stabilizer being transversely extendable against the sidewalls of the drill hole for periodically stabilizing said retractable body and transversely retractable for operating said drill when said drill is secured with said drill stabilizer, a control means for periodically moving said drill by extending and retracting said drill stabilizer, extending and retracting said position stabilizer and adjusting length of said retractable body.

2. The tractor device of claim 1 wherein at least one piston is attached to a front drilling portion and a rear trailing portion of said retractable body for controlling length of said retractable body and pressurizing said drill; and said retractable body contains a slideable shaft interlocking with a housing for protecting said piston from torque that arises during rotating of said drill.

3. The tractor device of claim 1 wherein said drill stabilizer contains at least three transverse shoes for stabilizing said drill.

4. The tractor device of claim 3 wherein said transverse shoes are variably extendable for controlling direction of said drill.

5. The tractor device of claim 4 wherein a guidance device is attached to said retractable body for determining path of said drill.

6. The tractor device of claim 1 wherein said rear trailing end of said retractable body is connected to a flexible conduit for supplying power to said drill and the tractor.

7. A tractor device for locomoting a drilling apparatus comprising:

a retractable body, said retractable body having a drill attached to a front drilling end of said retractable body and said retractable body having at least one piston for longitudinally extending and retracting for adjusting length of said retractable body and pressurizing said drill against the forward end of a drill hole during drilling, said piston being mounted within a slideable shaft, said slideable shaft interlocking with a housing for protecting said piston from torque, a drill stabilizer attached to a rear trailing end of said retractable body for stabilizing said drill during drilling, said drill stabilizer being transversely extendable against sidewalls of the drill hole for securing said retractable body during drilling and said drill stabilizer being transversely retractable for allowing movement of said retractable body, a position stabilizer attached to said front drilling end of said retractable body, said position stabilizer being transversely extendable against the sidewalls of the drill hole for periodically stabilizing said retractable body and said position stabilizer being transversely retractable for operating said drill when said drill is secured with said drill stabilizer, a control means for periodically moving said drill by extending and retracting said drill stabilizer, extending and retracting said position stabilizer and adjusting length of said retractable body, and a flexible conduit attached to said rear trailing end of said retractable body for supplying power to said drill and the tractor.

8. The tractor device of claim 7 wherein at least three hydraulic pistons are connected to said front drilling end and said rear trailing end of said retractable body for controlling length of said retractable body.

9. The tractor device of claim 7 wherein said drill stabilizer contains at least three transverse shoes for stabilizing and steering said drill.

10. The tractor device of claim 9 wherein said transverse shoes are connected to a guidance control device for controlling direction of said drill.

11. The tractor device of claim 10 wherein a guidance device is attached to said retractable body for determining path of said drill.

12. The tractor device of claim 7 wherein said flexible conduit supplies hydraulic power to the tractor and supplies pneumatic power through the tractor to said drill.

13. A method of locomoting drilling apparatus comprising the steps of:

laterally extending a drill stabilizer against a sidewall of a drill hole to stabilize a tractor in the drill hole, said tractor having a rear trailing end, a front drilling end and a drill attached to said front drilling end, said drill stabilizer being attached to said rear trailing end of said tractor, longitudinally extending a retractable body to pressurize an operating drill against the forward end of a drill hole, said retractable body being connected to said rear trailing end and said front drilling end of said tractor, laterally extending a position stabilizer against sidewalls of the drill hole to secure said drill and retracting said drill stabilizer to release said rear trailing end of said tractor, said position stabilizer being connected to said front drilling end of said tractor, retracting said retractable body to transport said drill stabilizer forward into said drill hole, and laterally extending said drill stabilizer against a forward position of said sidewall of said drill hole to stabilize said tractor, retracting said position stabilizer and longitudinally extending said retractable body to pressurize said drill against the forward end of a drill hole during operation of said drill.

14. The method of claim 13 including the additional step of directionally extending said drill stabilizer to guide said drill.

15. The method of claim 13 including the additional step of locating cracks and voids with said drill stabilizer and said position stabilizer.

16. The method of claim 13 wherein said drilling is continuous.

17. The method of claim 13 including the additional step of rotating said drill with a hydraulic motor.

18. The method of claim 17 including the additional step of pneumatically removing cuttings from the forward end of the drill hole.

* * * * *